US006328587B1

(12) United States Patent
Hsu

(10) Patent No.: US 6,328,587 B1
(45) Date of Patent: Dec. 11, 2001

(54) CONTACT FOR A ZIF SOCKET TYPE CONNECTOR

(76) Inventor: Feng-Chien Hsu, No. 6-1, Lane 114, Ming-Te St., Hsinchuang City, Taipei Hsien (TW)

( * ) Notice: Subject to any disclaimer, the term of this patent is extended or adjusted under 35 U.S.C. 154(b) by 0 days.

(21) Appl. No.: 09/852,772

(22) Filed: May 11, 2001

(51) Int. Cl.[7] ..... H01R 13/625
(52) U.S. Cl. ..... 439/342; 439/259
(58) Field of Search ..... 439/342, 259, 439/261, 262, 263, 264, 265, 266

(56) References Cited

U.S. PATENT DOCUMENTS 5,443,591 * 8/1995 Tsai ..... 439/342
5,454,727 * 10/1995 Hsu ..... 439/342
5,492,488 * 2/1996 Hsu ..... 439/342

* cited by examiner

*Primary Examiner*—Tho D. Ta
(74) *Attorney, Agent, or Firm*—Fei-Fei Chao; Venable, Baetjer, Howard & Civiletti, LLP

(57) ABSTRACT

A contact for fitting in a ZIF socket type connector is formed substantially as an Y-shaped member having a leg extending downward in a vertical direction, a fixing section extending upward in a vertical direction and a flexible contacting section extending upward in an inclined direction. The contacting section is formed as an inverted L-shaped member having a lower end thereof connecting an upper end of the leg and an upper end thereof formed with a horizontal portion, which has a protrusion extending horizontally from one side thereof, and particularly has a rounded edge formed at a lower corner of an outer end of the protrusion. Whereby the contact is able to be accurately inserted into a cavity defined in a base of the connector without any interference so as to ensure transmission quality of the electrical signal.

4 Claims, 6 Drawing Sheets

CONTACT FOR A ZIF SOCKET TYPE CONNECTOR

BACKGROUND OF THE INVENTION

1. Field of the Invention

The present invention relates to a contact for a zero-insert-force (ZIF) socket type connector, the contact particularly having a structure, which enables the contact to be accurately inserted into a cavity in a base of the connector without any interference.

2. Description of Related Art

ZIF socket type connectors are widely used in the computer field. The socket connector normally comprises a base having a plurality of vertically extending cavities defined therein and a plurality of contacts respectively received in the plurality of cavities. The contact is generally formed in a Y shape having a leg for extending through a hole defined in a bottom of the cavity, a fixing section for fitting in the cavity, and a flexible contacting section for contacting a terminal pin of a chip. A guide portion is integrally formed at an upper end of the contacting section. One side of the guide portion is integrally formed with a positioning member extending perpendicularly to the guide portion. The positioning member has its outer end thereof extended to a position nearly mated with an inner side wall of the cavity, whereby in the assembly a lower comer of the outer end of the positioning member often strikes an upper edge of the cavity. If the contacts are forcefully inserted into the cavities and interference occurs, the contacts will be deformed, which causes poor transmission of electrical signals. Related information dealing with such situation is disclosed in U.S. Pat. No. 5,342,214.

Therefore, it is an objective of the invention to provide an improved contact of the ZIF socket type connector to mitigate and/or obviate the aforementioned problems.

SUMMARY OF THE INVENTION

The object of the present invention is to provide a contact for a ZIF socket type connector particularly having a flexible contacting section with a rounded edge formed at a lower comer of an outer end of a protrusion extended perpendicularly from the contacting section so as to prevent the contact from striking an upper edge of a cavity defined in a base of the connector in the assembly process, and to ensure the contact is accurately fitted in a cavity and contacted with a terminal pin inserted into the cavity in a good connection.

The detailed features of the present invention will be apparent in the detailed description with appropriate reference to the accompanying drawings.

DETAILED DESCRIPTION OF THE PREFERRED EMBODIMENT

Figure 1:
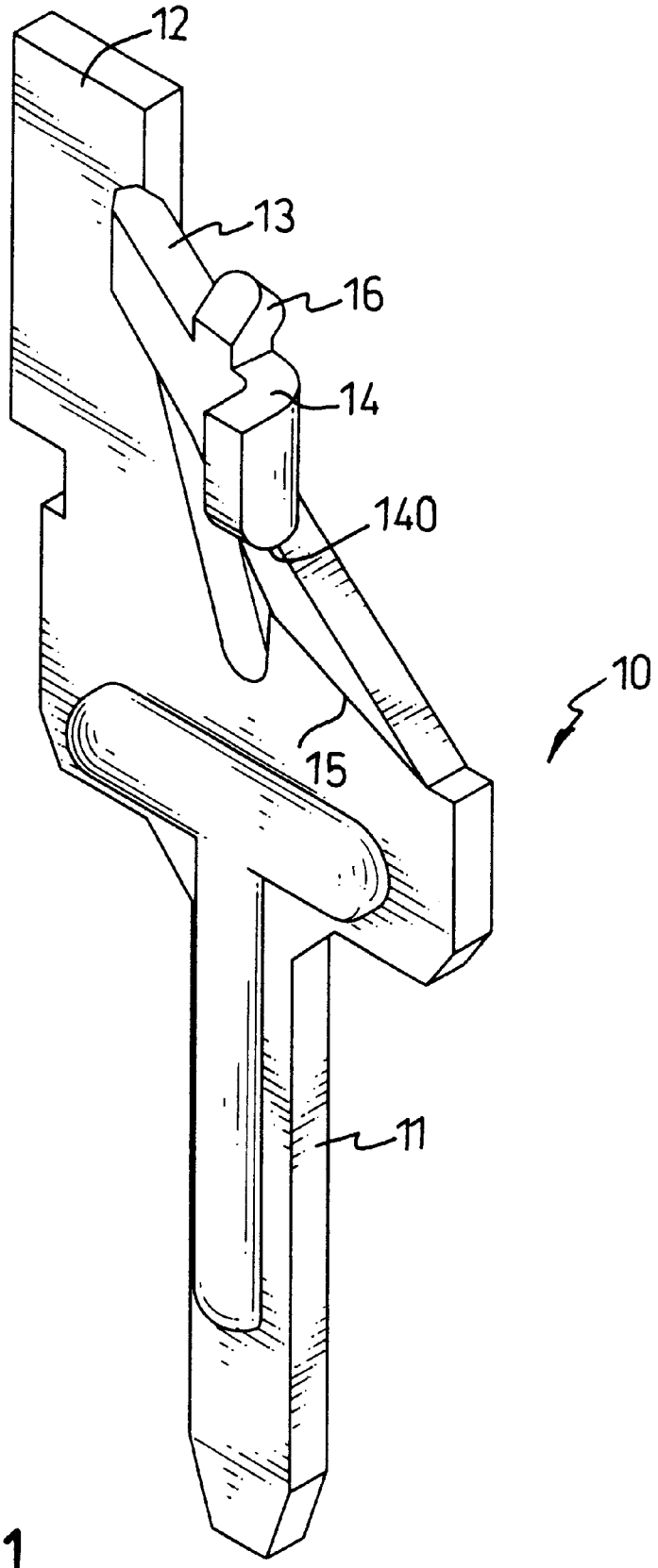
FIG. 1 is a perspective view of a contact for a ZIF socket type connector in accordance with the present invention.
Figure 4:
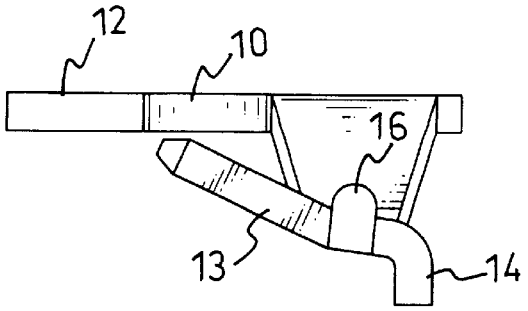
FIG. 4 is a top plan view of the contact in accordance with the present invention.
Figure 2:
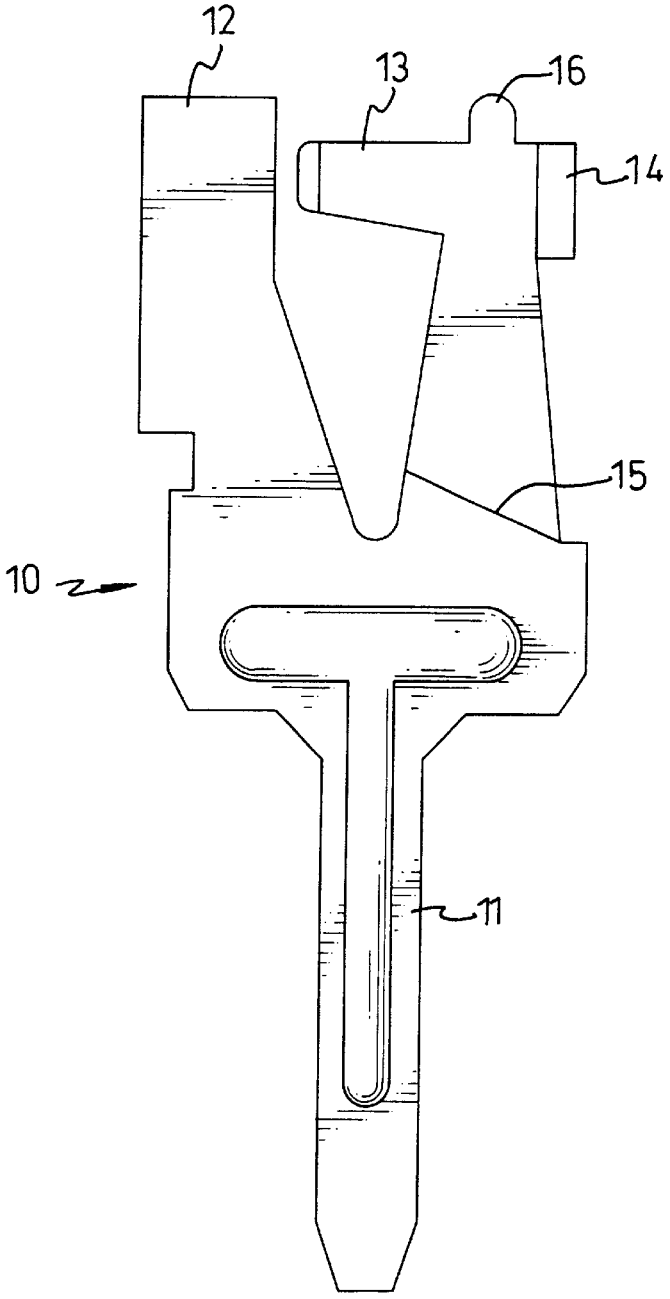
FIG. 2 is a front plan view of the contact in accordance with the present invention.
Figure 3:
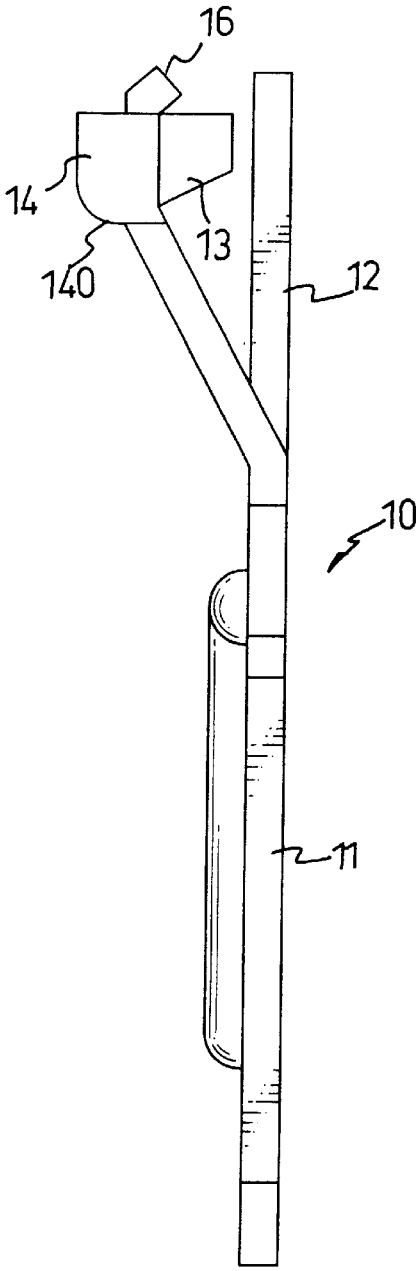
FIG. 3 is a right plan view of the contact in accordance with the present invention.

As shown in FIGS. 1 to 4, the present invention relates to a contact (10) for a ZIF socket type connector. The contact (10) is an integrally formed as a substantially Y-shaped member including a leg (11) extending downward in vertical direction, a fixing section (12) extending upward in vertical direction and a flexible contacting section (13) extending upward in an inclined direction. The flexible contacting section (13) is formed as an inverted L-shape member having a lower end thereof formed with a bend (15) in connection with an upper end of the leg (11), and an upper end thereof formed with a horizontal portion.

The horizontal portion of the contacting section (13) has a first side thereof extending opposed to the fixing section (12) and a second side thereof extending towards the fixing section (12) in an inclined direction. A protrusion (14) is extended horizontally in perpendicular direction from the first side of the horizontal portion of the contacting section (13) to perform as a positioning means of the contact (10). The contacting section (13) further has a retaining stub (16) integrally formed on an upper end of the horizontal portion thereof in order to prevent the contacting section (13) from over deformation against resilience thereof. The protrusion (14) particularly has a rounded edge (140) formed at a lower corner of an outer end thereof.

Figure 5:
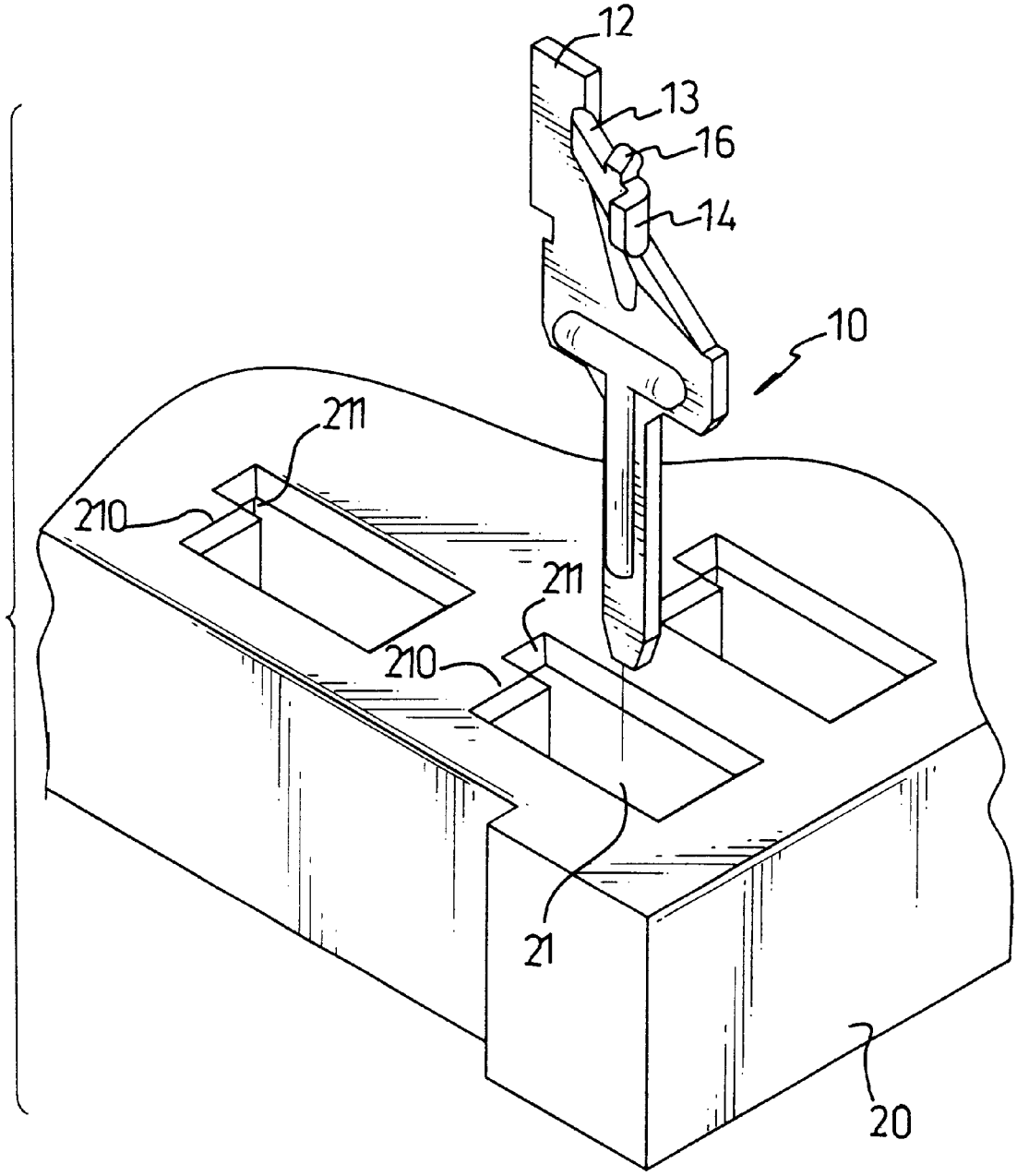
FIG. 5 is a partial perspective view of the invention, showing the contact not inserted into a cavity of a base of the connector.

As shown in FIG. 5, a base (20) for the ZIF socket type connector is defined with a plurality of cavities (21). Each one of the cavities (21) has a guide block (210) formed at one inner side thereof and a guide slot (211) defined therein corresponding to the fixing section of the contact (10).

Figure 6A:
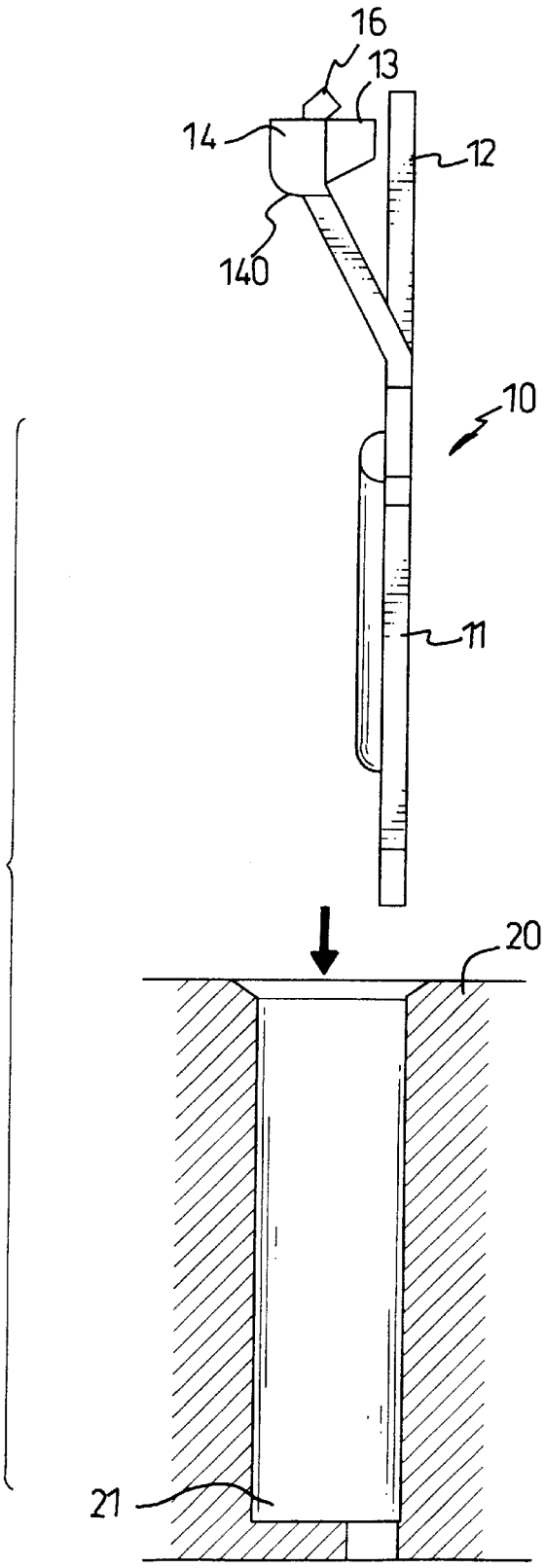
FIGS. 6A and 6B are schematic cross sectional views of the invention, showing the contact being inserted into the cavity.
Figure 6B:
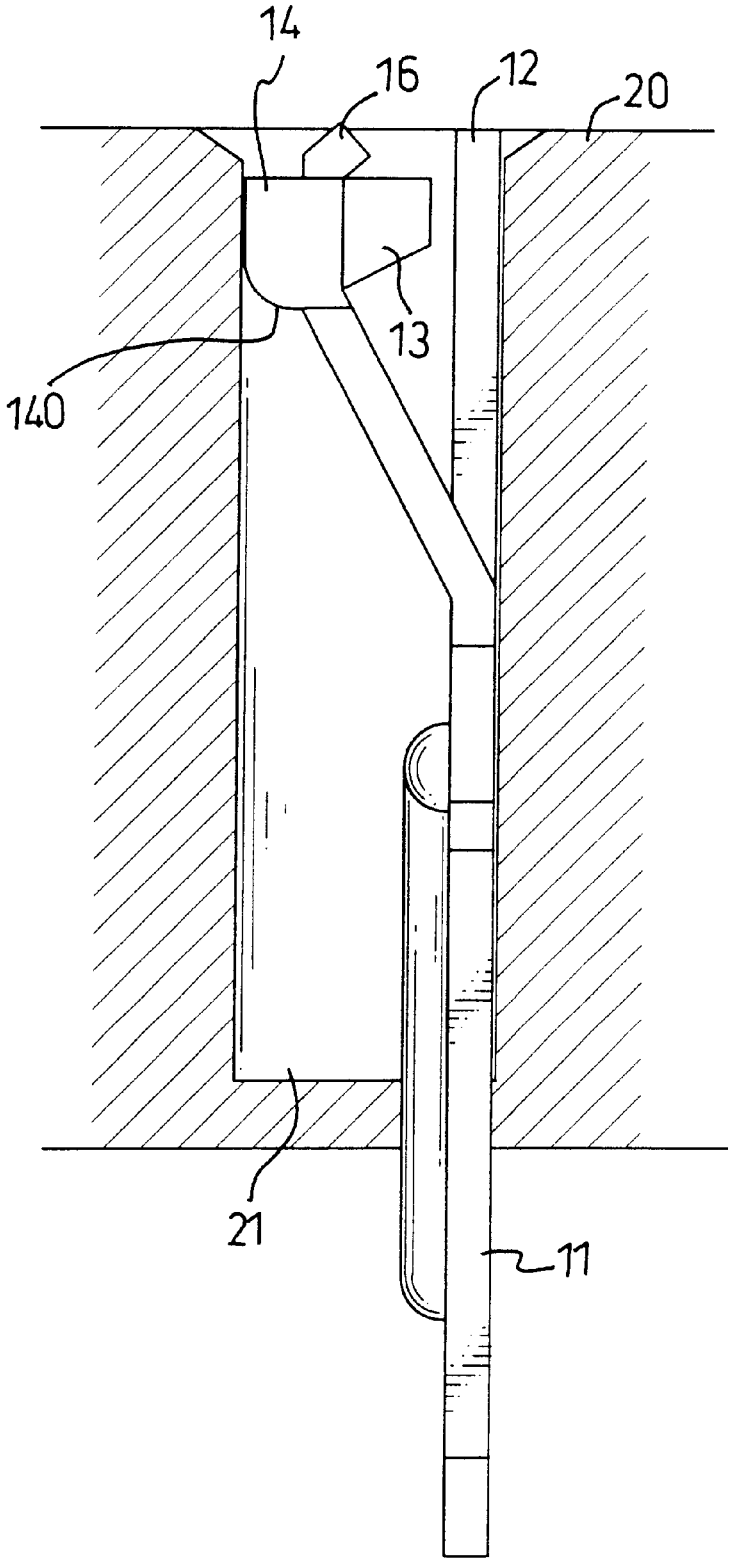

As shown in FIGS. 6A and 6B, the contact (10) is inserted into the cavity (21) from an upper opening of the cavity (21). Because of the rounded edge (140) formed at the lower corner of the outer end of the protrusion (14) and the resilience of the flexible contacting section (13), the protrusion (14) is avoided from striking directly an edge of the upper opening of the cavity (21). In a downward movement of the contact (10) with respect to the cavity (21) of the base (20), the edge of the upper opening of the cavity (21) slides along the rounded edge (140) of the protrusion (14). Therefore the contact (10) is accurately inserted into the cavity (21) without any interference, and the leg (11) of the contact (10) is extended through a through hole (not designated) defined in a bottom of the cavity (21).

Figure 7A:
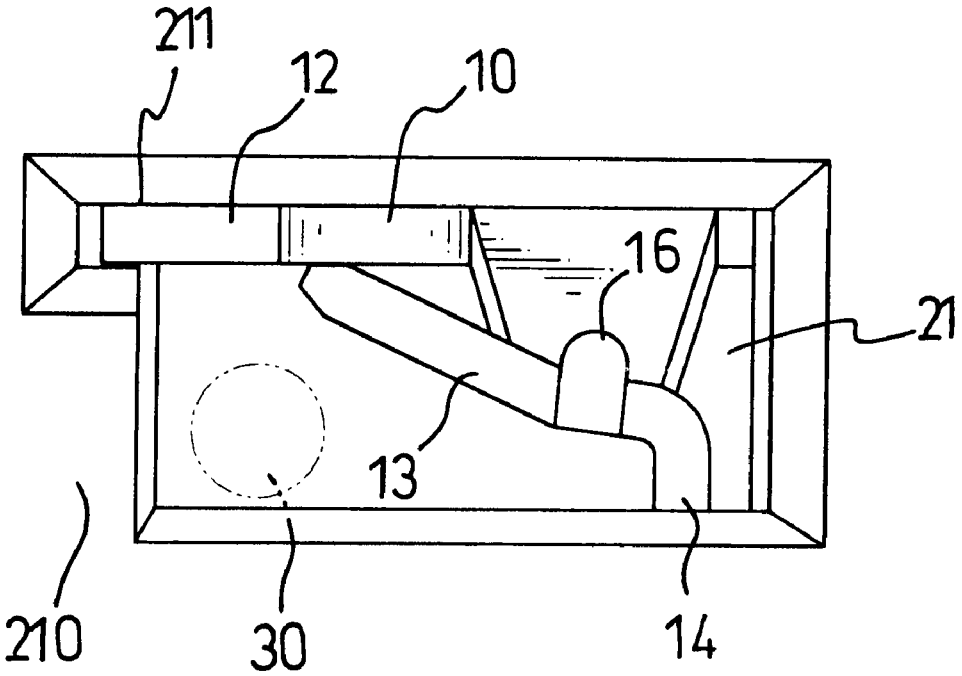
FIGS. 7A and 7B are schematic top plan views of the invention, showing a state of a terminal being inserted into the cavity.
Figure 7B:
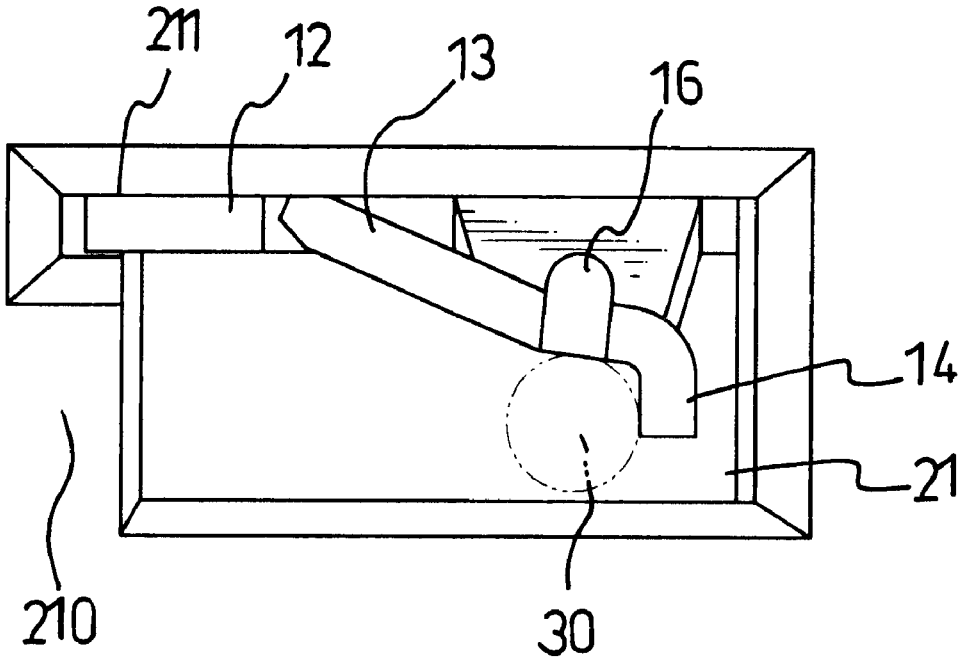

With reference to FIGS. 7A and 7B, the fixing section (12) is fitted in the guide slot (211) and retained by the guide block (210). By the resilience of the flexible contacting section (13), the contact (10) is reliably positioned in the cavity (21).

When a terminal pin (30) of a chip is vertically inserted into the cavity (21) but before the terminal pin (30) electrically connects the contact (10), the terminal pin (30) remains at a disconnection position, in which the terminal pin (30) is spaced apart from the contacting section (13). When the terminal pin (30) of the chip is pressed to move towards the contacting section (13), the terminal pin (30) is clamped at a connection position, in which the terminal pin (30) is securely clamped between the flexible contacting section (13) and an inner side wall of the cavity (21).

The advantage of the invention is that the contact (10) is able to be inserted into the cavity (21) without any interference, because the contacting section (13) has the rounded edge (140) formed at the lower comer of the outer end of the protrusion (14).

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A contact (10) for a ZIF socket type connector, the contact (10) being formed as a substantially Y-shaped member having a leg (11) extending downward in a vertical direction, a fixing section (12) extending upward in a vertical direction, and a flexible contact section (13) extending upward in an inclined direction, wherein the improvements comprise:

the flexible contacting section (13) is formed as an inverted L-shape member having a lower end thereof in connection with an upper end of the leg (11), and an upper end thereof formed with a horizontal portion;

the horizontal portion of the contacting section (13) has a first side thereof extending opposed to the fixing section (12) and a second side thereof extending towards the fixing section (12);

a protrusion (14) is extended horizontally in perpendicular direction from the first side of the horizontal portion of the contacting section (13); and a rounded edge (140) is formed at a lower comer of an outer end of the protrusion (14).

2. The contact (10) for the ZIF socket type connector as claimed in claim 1, wherein the contacting section (13) has a retaining stub (16) integrally formed on an upper end of the horizontal portion thereof.

3. The contact (10) for the ZIF socket type connector as claimed in claim 1, wherein the second side of the horizontal portion of the contacting section (13) is extended towards the fixing section (12) in an inclined direction.

4. The contact (10) for the ZIF socket type connector as claimed in claim 1, wherein the lower end of the contacting section (13) is formed with a bend (15) in connection with an upper end of the leg (11).

* * * * *